US005349319A

United States Patent [19]

Isozumi et al.

[11] Patent Number: 5,349,319

[45] Date of Patent: Sep. 20, 1994

[54] STARTER

[75] Inventors: Shuzoo Isozumi; Akira Morishita, both of Hyogo, Japan

[73] Assignee: Mitsubishi Denki Kabushiki Kaisha, Tokyo, Japan

[21] Appl. No.: 28,611

[22] Filed: Mar. 8, 1993

Related U.S. Application Data

[60] Continuation of Ser. No. 554,646, Jul. 19, 1990, which is a division of Ser. No. 331,131, Mar. 31, 1989.

[30] Foreign Application Priority Data

Apr. 1, 1988 [JP] Japan ..... 63-44921
May 12, 1988 [JP] Japan ..... 63-63781

[51] Int. Cl.[5] ..... H01F 7/08; H01F 7/13

[52] U.S. Cl. ..... 335/274

[58] Field of Search ..... 335/126, 129, 131, 248, 335/255, 256, 257, 258, 262, 270, 271, 274, 277

[56] References Cited

U.S. PATENT DOCUMENTS

| | | | |
|---|---|---|---|
| 1,640,742 | 8/1927 | Wallace | 251/129 |
| 2,650,617 | 9/1953 | Wasser | 335/255 |
| 3,505,628 | 4/1970 | Allen | 335/255 |
| 3,735,302 | 5/1973 | Eckert | 335/262 |
| 4,014,425 | 3/1977 | Gijzen et al. | 335/257 |
| 4,258,749 | 3/1981 | Mayer | 251/129 |
| 4,829,275 | 5/1989 | Croy | 335/273 |

FOREIGN PATENT DOCUMENTS

| | | |
|---|---|---|
| 2112799 | 9/1975 | Fed. Rep. of Germany . |
| 2522454 | 12/1975 | Fed. Rep. of Germany . |
| 7731335 | 3/1979 | Fed. Rep. of Germany . |
| 2636985 | 4/1980 | Fed. Rep. of Germany . |

*Primary Examiner*—Leo P. Picard
*Assistant Examiner*—Raymond Barrera
*Attorney, Agent, or Firm*—Sughrue, Mion, Zinn, Macpeak & Seas

[57] ABSTRACT

In a starter, the pinion, which is rotated by torque of an electric motor, is slid axially by the plunger of an electromagnetic switch and is pushed against the engine ring gear by a conically coiled compression coil, which allows employment of a small electromagnetic switch. Further, in an electromagnetic switch in which the plunger confronted coaxially with the stationary iron core slidably supporting a rod with a movable contact is moved towards the stationary iron core by electromagnetic force, a conically coiled spring is interposed between the plunger and the stationary iron core in such a manner that the spring is substantially coaxial with the plunger and the iron core, so that the playing of the rod is prevented.

5 Claims, 7 Drawing Sheets

STARTER

This is a continuation of application Ser. No. 07/554,646 filed Jul. 19, 1990, which is a divisional of application Ser. No. 07/331,131 filed Mar. 31, 1989.

BACKGROUND OF THE INVENTION

1. Field of the Invention

This invention relates to starters, and more particularly to an improvement of springs used in the starters.

2. Prior art

A conventional starter for staring a vehicle engine is designed as shown in FIG. 1.

More specifically, the conventional starter device 1, as shown in FIG. 1, comprises: a DC motor 2; an over-running clutch 4 slidably mounted on the output rotary shaft 3 of the motor; an electromagnetic switch 6 provided beside the DC motor 2; and a shift lever 10 having one end engaged with a hook 8 coupled to the plunger 7 of the electromagnetic switch 6 and the other end engaged with the cylindrical rear end portion 9 of the over-running clutch outer portion 4*b* of the over-running clutch 4 so as to slide the over-running clutch 4 on the output rotary shaft 3.

The electromagnetic switch 6 for operating the shift lever 10 has a cylindrical outer frame 11 which has a wall 11*a* at one end. The aforementioned plunger 7 is inserted into the end wall 11*a*. A stationary iron core 12 is disposed at the other end of the outer frame 11 in such a manner as to confront with the plunger 7. The iron core 12 has an end wall 12*a* which is fixedly fitted in the rear end portion of the outer frame 11, thus forming a frame together with the outer frame 11. A coil bobbin 13 is accommodated in the frame thus formed. An exciting coil 14 is wound on the coil bobbin 13. A return spring 15 is interposed between the iron core 12 and the plunger 7. The iron core 12 has a central through-hole, into which a rod 16 is slidably inserted in such a manner that its one end portion (or front end portion) is extended from the iron core 12 towards the plunger 7. The other end portion (or rear end portion) of the rod 16 supports a movable contact 17.

The starter further comprises: a return spring 18 for returning the rod 16 to a predetermined position; a cap 19 made of resin; and a terminal bolt 20 embedded in the cap 19 so that its inner end serves as a stationary contact 20*a* with which the movable contact 17 is brought into contact.

The plunger 7 is inserted into the central opening formed in the end wall 11*a* of the outer frame 11, and it is moved along the central axis of the coil bobbin 13 towards the iron core 12. The plunger 7 has a recess 7*a* which is opened axially outward. The above-described hook 8 is in the form of a piston and has a flange 8*a* at the rear end. The hook 8 is slidably inserted into the recess 7*a* of the plunger 7 and is extended outside passing through the central hole that is formed in a holder 21, which closes the open end of the recess 7*a* of the plunger 7. The outer end portion of the hook 8 is engaged with the upper end of the shift lever 10. Inside the recess 7*a* of the plunger 7, a cylindrically coiled spring, namely, a compression spring 22 is interposed between the holder 21 and the flange 8*a* of the hook 8.

The operation of the conventional starter thus constructed will be described in brief.

When the key switch of the vehicle is turned on, the exciting coil 14 of the electromagnetic switch 6 is energized so that the plunger 7 is moved towards the iron core 12. As a result, the shift lever 10 is turned, whereby the over-running clutch 4 and the pinion 5 integral with the clutch inner portion 4*a* are slid on the output rotary shaft 3. In this operation, when the pinion 5 abuts against the side of the engine ring gear, the turning of the shift lever 10 is stopped, while the plunger 7 continues to move towards the iron core, the compression spring 22 is compressed, so that the pinion is pushed against the engine ring gear through the shift lever 10.

As the plunger 7 pushes the rod 16, the movable contact 17 is brought into contact with the stationary contact 20*a*, so that the DC motor 2 is energized. As a result, as soon as the pinion 5 is rotated, it is engaged with the engine ring gear by the elastic force of the compression spring 22.

The relationships between the attracting force of the plunger 7 and the elastic force of the compression spring 22 in the electromagnetic switch is as shown in the characteristic diagram of FIG. 2, in which the vertical axis represents force, and the horizontal axis represents the distance (or gap) q between the plunger 7 and the iron core 12. That is, in FIG. 2, the curves P and P' indicate plunger attracting force characteristics, and the straight line S represents the spring characteristic of the compression spring 22. In general, the power source for the starter is a 12 V storage battery and, in this case, the plunger attracting force characteristic is as indicated by the curve P. However, in practice, the exciting coil 14 is energized with a voltage which is about two-thirds ($\frac{2}{3}$) of the system voltage because of various factors such as temperature rise; that is, when a voltage of about 8 V is applied to the exciting coil 14, the plunger attracting force characteristic is as indicated by the curve P'.

On the other hand, when the movement of the plunger 7 causes pinion 5 to abut against the engine ring gear, the compression spring 22 becomes effective, and the spring characteristic changes linearly with the movement of the plunger 7.

As shown in FIG. 2, the plunger attracting force characteristic curve P' comes in contact with the characteristic curve S of the compression spring 22 when the attracting force is reduced slightly because of a decrease in the voltage. At the contact point, the plunger attracting force is in balance with the elastic force of the compression spring 22. Accordingly, the plunger 7 is no longer moved towards the iron core 12, as a result of which the DC motor 2 is not energized. This difficulty may be overcome by using a compression spring smaller in elastic force. However, the method is not practical, because the elastic force thereof may not be large enough to cause the pinion to engage with the engine ring gear.

In the electromagnetic switch thus constructed, the coiled spring 15 for returning the plunger 7 is disposed between the plunger 7 and the stationary iron core 12 in such a manner that it is positioned closest to the inner cylindrical wall of the coil bobbin 13 as shown in FIG. 1, thus reducing the magnetic cross section of the magnetic path. Accordingly, the force of attracting is decreased, and especially the initial force of attracting the plunger is decreased.

In order to overcome this difficulty, the conventional magnetic switch 6 has been improved as shown in FIG. 3. That is, in the improved magnetic switch, the coiled spring 15 is disposed between the plunger 7 and the stationary iron core 12 in such a manner that it is located closest to the central axis of the coil bobbin 13 so as to maintain the magnetic cross section of the magnetic path.

However, the electromagnetic switch is still disadvantageous in the following point: In the electromagnetic switch, the coiled spring 15 is inserted into a recess which is formed along the through-hole of the iron core 12, into which the rod 16 is inserted, in such a manner that it is deep enough to support the base portion of the spring 15. Therefore, the dimension a of the rod supporting portion of the iron core is decreased, and the rod 16 will have less support, thereby resulting in increased perpendicular movement of the rod 16 relative to the spring 15.

SUMMARY OF THE INVENTION

Accordingly, an object of this invention is to eliminate the above-described difficulty accompanying a conventional starter.

More specifically, an object of the invention is to provide a starter in which, with a small electromagnetic switch, the plunger can be moved against a compression spring having a certain elastic force.

Another object of the invention is to provide an electromagnetic attracting unit which maintains the magnetic cross section without causing the playing of the rod and other disadvantages, thus providing a great force of attraction.

The foregoing object and other objects of the invention have been achieved by the provision of a starter in which a pinion, which is rotated by torque of an electric motor, is slid axially by the plunger of an electromagnetic switch, and is pushed against an engine ring gear by a compression spring before rotated; in which, according to the invention, said compression spring is a conically coiled spring.

The foregoing object and other objects of the invention have been achieved by the provision of an electromagnetic attracting unit in which a movable iron core confronted coaxially with a stationary iron core is moved towards the stationary iron core by electromagnetic force, which comprises: a conically coiled spring interposed between the stationary iron core and the movable iron core in such a manner that the spring is substantially coaxial with the stationary iron core and the movable iron core.

When, in the starter of the invention, the plunger of the electromagnetic switch is moved to slide the pinion along the axis, the conically coiled spring is compressed to push the pinion against the engine ring gear. In this operation, the conically coiled spring is deflected (compressed) beginning with its end larger in diameter, thus showing a spring characteristic similar to a plunger attracting force characteristic. Therefore, the force of the attracting the plunger will never become in balance with the force of deflecting the conically coiled spring.

In the electromagnetic attracting unit, as the movable iron core is attracted to the stationary core, the conically coiled spring is compressed. In this operation, each of the coils of the spring goes in the next coil larger in diameter, and therefore the compressed length of the spring is considerably short. Therefore, the recess formed in the end face of the stationary iron core to receive the spring compressed can be short in axial length, which eliminates that above-described difficulty that the magnetic cross section is reduced.

The nature, principle and utility of the invention will become more apparent from the following detailed description when read in conjunction with the accompanying drawings.

DETAILED DESCRIPTION OF THE PREFERRED EMBODIMENTS

Preferred embodiments of this invention will be described with reference to the accompanying drawings.

Figure 4:
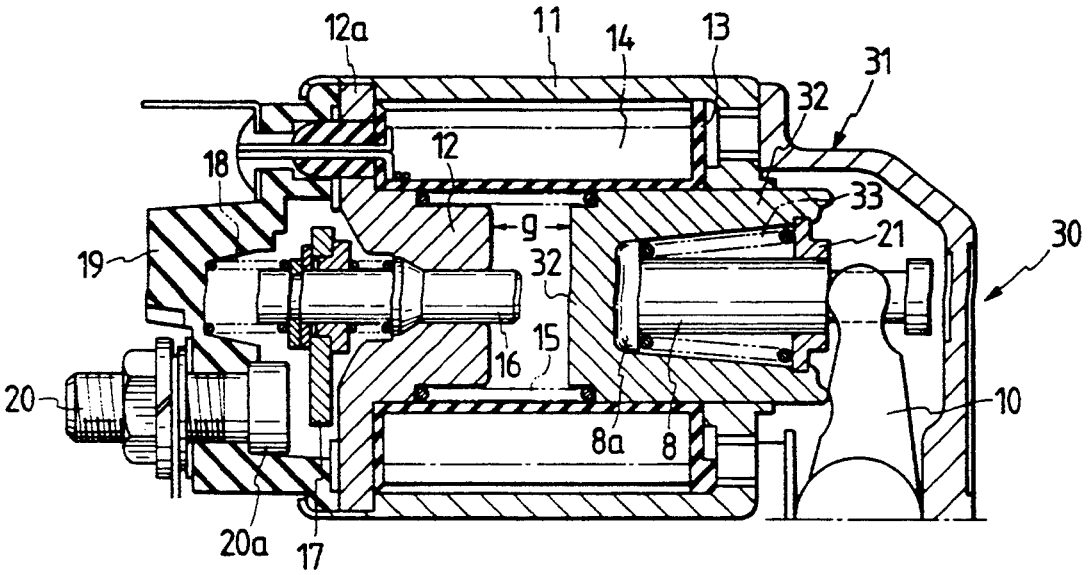
FIG. 4 is a sectional view showing an electromagnetic switch in a starter according to this invention.
Figure 5:
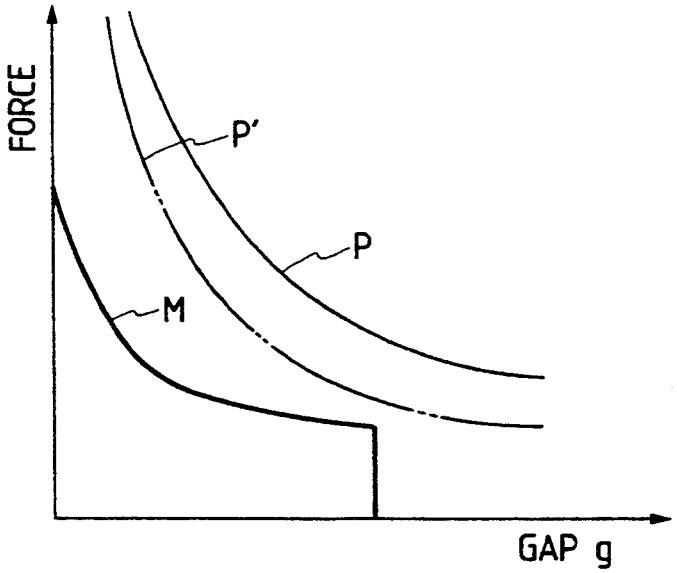
FIG. 5 is a characteristic diagram showing the force of attraction of the electromagnetic switch and the spring characteristic of a compression spring adapted to push a pinion in the starter of the invention.

A first example of a starter, according to the invention, is shown in FIG. 4, in which components corresponding functionally to those which have been described with reference to FIG. 5 are therefore designated by the same reference numerals or characters.

As shown in FIG. 4, the starter 30 has an electromagnetic switch 31, in which, instead of the cylindrically coiled spring (FIG. 1) in the conventional starter, a conically coiled spring 33 is disposed between the rear end flange 8*a* of a hook 8 and a holder 21. When loaded, the conically coiled spring 33 is deflected (compressed) beginning with its outer end which is larger in diameter. Therefore, the spring characteristic of the conically coiled spring 33 is as indicated by the curve M in FIG. 5 which is similar to the plunger 32 attracting force characteristic curve P. Therefore, when the exciting coil 14 of the electromagnetic switch 31 is energized with a voltage (about 8 V) about two-thirds of the system voltage or a lower voltage, the plunger attracting force characteristic curve P′ comes closer to the spring characteristic curve M. However, the plunger attracting force characteristic curve P′ will never contact the spring characteristic curve M. That is, the problem of the plunger attracting force being in balance with the elastic force of the compression spring 33 thereby causing the plunger 32 to be held stopped is eliminated. As is apparent from the curve M, as the force of deflection increases, the load applied to the conically coiled spring is increased like an inverse exponential curve. Therefore, immediately before the movable contact 17 is brought into contact with the stationary contact 20*a*, while the rod 16 is pushed by the plunger 32, the pinion is sufficiently pushed against the engine ring gear.

Figure 6:
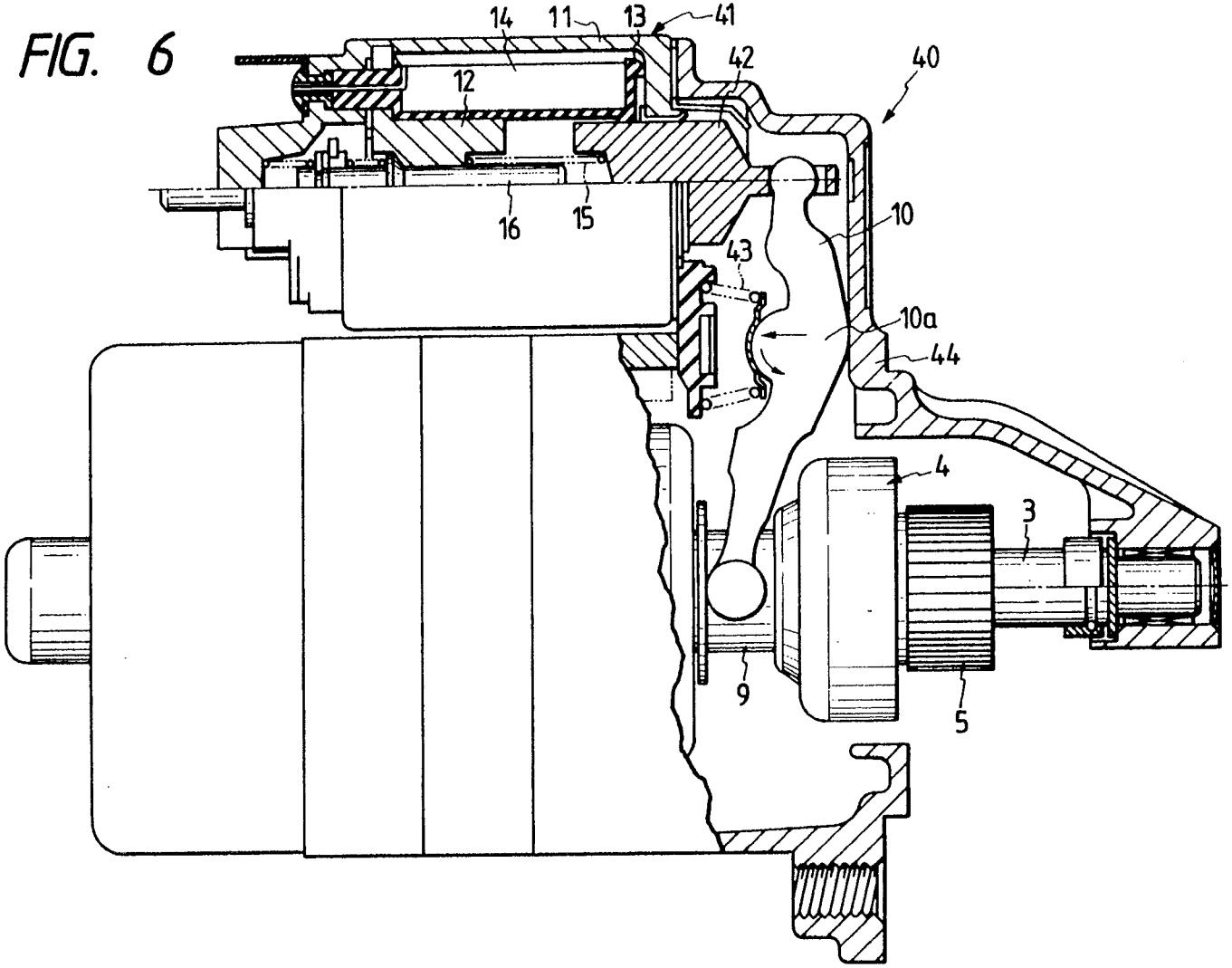
FIG. 6 is a sectional diagram showing part of the starter according to the invention.

FIG. 6 shows a second example of the starter according to the invention. In the starter 40, the upper end of a shift lever 10 is connected directly to the plunger 42 of an electromagnetic switch 41, and the fulcrum portion 10*a* of the shift lever 10 is pushed against the inner wall of a front bracket 44 with a conically coiled spring 43.

In the starter 40, as the plunger 42 is moved in the electromagnetic switch 41, the upper end of the shift lever is pulled, so that the fulcrum portion 10*a* of the shift lever 10 is turned until the pinion 5 abuts against the engine ring gear. Then the fulcrum portion 10*a* is moved backwardly, as indicated by the arrow, so that the conically coiled spring 43 is deflected. The force of deflection of the conically coiled spring 43 causes the lower end of the shift lever 10 to move forwardly with the upper end of the shift lever as a fulcrum, so that the pinion 5 is pushed against the engine ring gear. In this case also, the force of pushing the pinion against the engine ring gear is as indicated by the curve M in FIG. 5.

Figure 7:
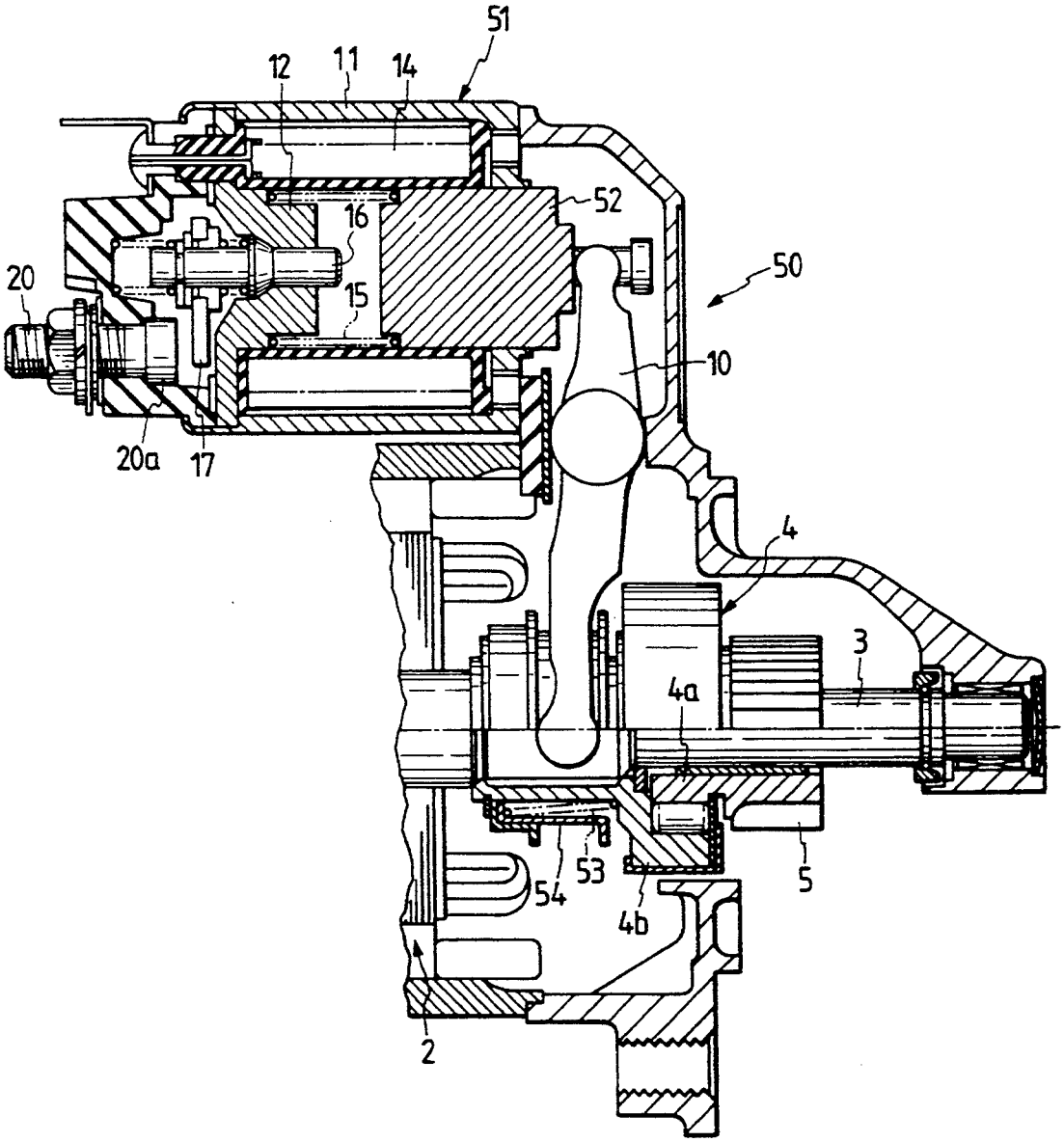
FIG. 7 is a sectional diagram showing part of the starter according to the invention.

FIG. 7 shows a third example of the starter according to the invention. In the starter 50, a conically coiled spring, namely, a compression spring 53 is mounted on the cylindrical portion of the clutch outer portion 4*b* in an over-running clutch 4 in such a manner that its one end abuts against the outer side surface of the clutch outer portion 4*b* and the other end abuts against the inner flange of an annular member 54. The lower end of the shift lever 10 is engaged with the outer cylindrical wall of the annular member 54, so that the over-running clutch 4 is moved through the annular member 54 and the compression spring 53 by the shift lever. When the pinion 5, integral with the clutch inner portion 4*a*, after being abutted against the engine ring gear, is further moved with the plunger being attracted, the turning of the shift lever deflects the compression spring 53, so that the pinion 5 is pushed against the engine ring gear by a force corresponding to the deflection of the compression spring. In this operation, the force of pushing the pinion against the engine ring gear, attributing to the deflection of the compression spring 53, is as indicated by the curve M in FIG. 5.

Figure 1:
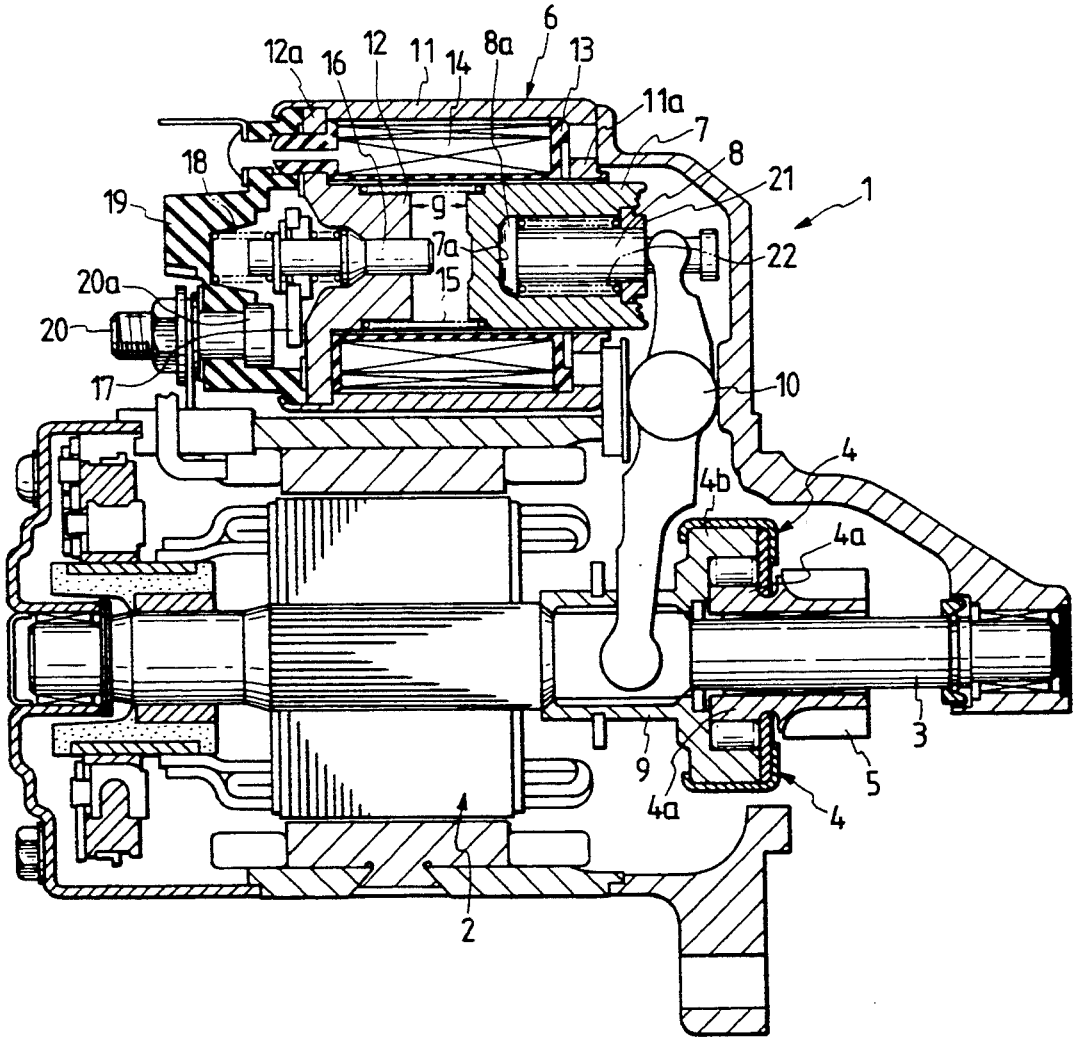
FIG. 1 PRIOR ART
FIG. 1 is a sectional view showing a conventional starter.
Figure 2:
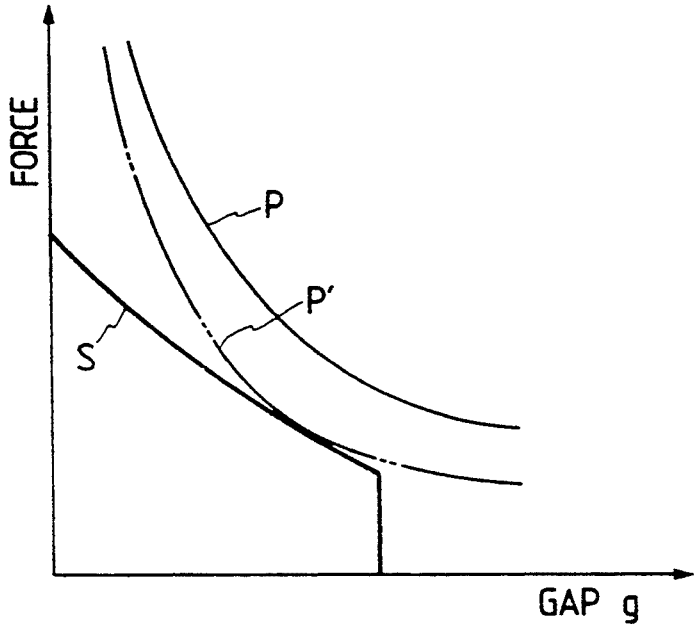
FIG. 2 PRIOR ART
FIG. 2 is a characteristic diagram indicating the force of attraction of the electromagnetic switch and the spring characteristic of a compression spring adapted to push a pinion in the conventional starter.
Figure 3:
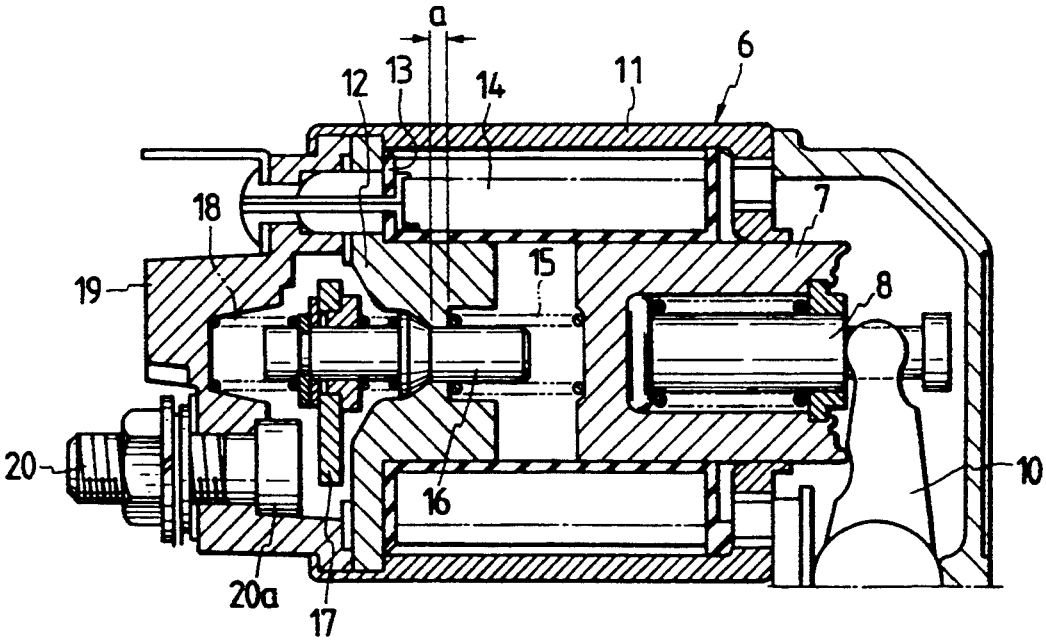
FIG. 3 PRIOR ART
FIG. 3 is a sectional view showing a conventional electromagnetic switch provided to improve the electromagnetic switch of the starter shown in FIG. 1.
Figure 8:
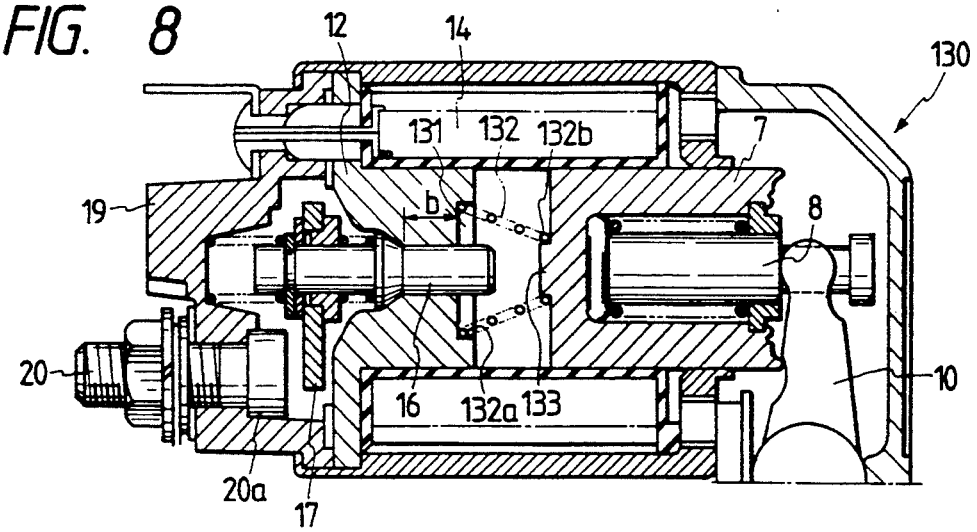
FIG. 8 is a sectional view showing an electromagnetic switch in a starter to which an electromagnetic attracting unit according to the invention is applied.
Figure 9:
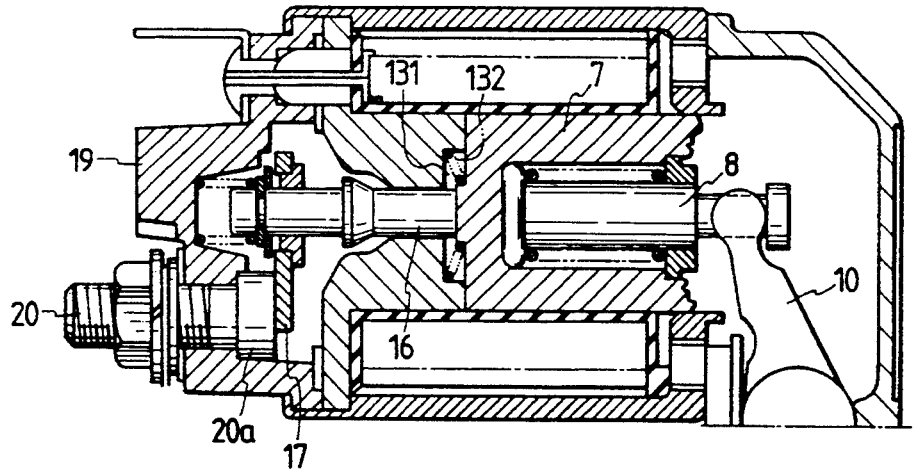
FIG. 9 is a sectional view showing a plunger attracted to a stationary iron core in the electromagnetic switch shown in FIG. 8.
Figure 10:
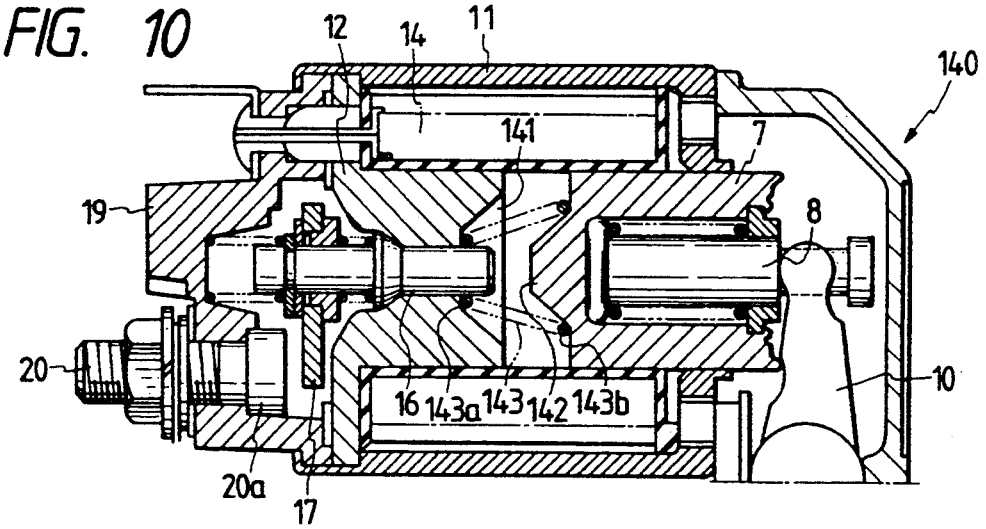
FIG. 10 is a sectional view showing an electromagnetic switch in a starter to which the electromagnetic attracting unit according to the invention is applied.
Figure 11:
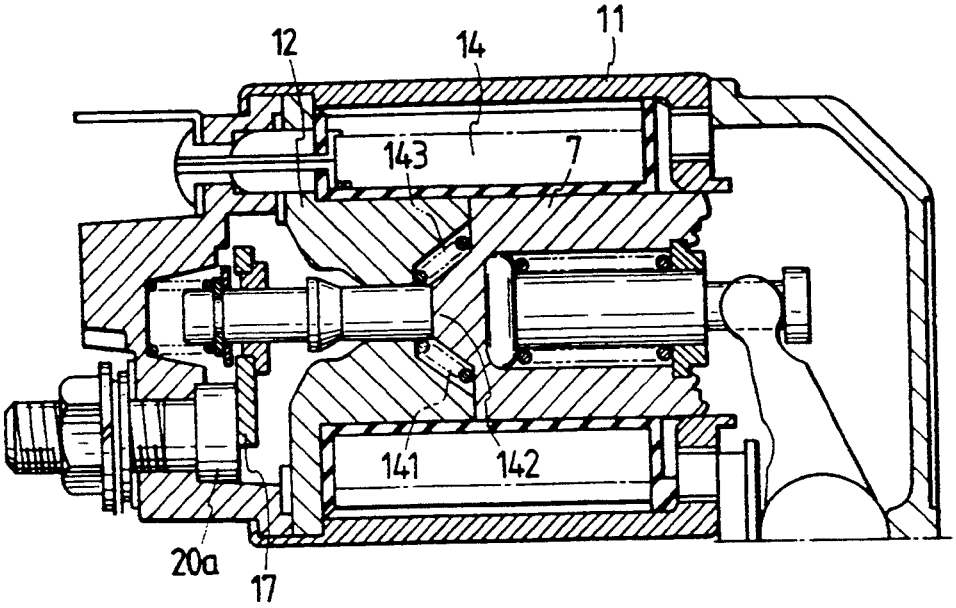
FIG. 11 is a sectional view showing a plunger attracted to a stationary iron core in the electromagnetic switch shown in FIG. 10.

Further, FIGS. 8 and 9 show an electromagnetic switch 130 to which a first example of an electromagnetic attracting unit according to the invention is applied, and FIGS. 10 and 11 show an electromagnetic switch 140 to which a second example of the electromagnetic attracting unit according to the invention is applied. In these figures, components corresponding functionally to those which have been previously described with reference to FIG. 1 are designated by the same reference numerals or characters.

In the electromagnetic switch 130, as shown in FIG. 8, a cylindrical recess 131 is formed in the inner end face of a stationary core 12 in such a manner that the central axis thereof coincides with that of the stationary iron core 12. One end portion 132*a* of a conically coiled spring 132, which is larger in diameter than the other end portion 132*b*, is positioned along the periphery of the bottom of the cylindrical recess. The depth of the recess 131, that is, the axial dimension of the recess is substantially equal to the length of the conically coiled spring compressed (hereinafter referred to as "a compressed length", when applicable).

The conically coiled spring 132 is gradually decreased in diameter from one end to the other end as is seen from its configuration. When the spring 132 is compressed, each of the coils goes inside the adjacent coil, which is larger in diameter, therefore the compressed length of the spring 132 is considerably small. Accordingly, the axial depth of the recess 131 formed in the inner end face of the stationary iron core 12 may be considerably small, the substantial length of the through-hole of the stationary iron core 12 is therefore long enough to support the rod 16, and the playing of the latter 16 is prevented.

On the other hand, a circular protrusion 133 small in thickness is formed on the inner end face of the plunger 7 at the center, which confronts with the stationary iron core 12. The small diameter end portion 132*b* of the conically coiled spring 132 is fitted on the circular protrusion 133. Thus, the conically coiled spring 132 has been positioned in place.

As is apparent from the above description, in the electromagnetic switch of the invention, without adversely affecting the operation of the electromagnetic switch, the plunger returning spring is set closer to the central axis of the stationary iron core than in the conventional electromagnetic switch, thus maintaining the magnetic cross section, with the result that the force of attraction is improved. In addition, when referring to FIG. 12, which indicates the force of attraction (the characteristic curve A) of the electromagnetic switch 130 of FIG. 8 and the force of attraction (the characteristic curve B) of the conventional electromagnetic switch 6 in FIG. 1, it can be seen that the former electromagnetic switch 130 is larger in the initial force of attraction than the latter electromagnetic switch 6.

In the electromagnetic switch 140, as shown in FIG. 10, a recess 141 in the form of a circular truncated cone is formed in the inner end face of the stationary iron core 12 in such a manner that the central axis of the recess is substantially coincident with that of the stationary iron core 12. On the other hand, a circular-truncated-cone-shaped protrusion 142 is formed on the inner end face of the movable iron core, namely, a plunger 7 at the center in such a manner that it is extended towards the stationary iron core 12. A conically coiled spring 143 is interposed between the plunger 7 and the stationary iron core 12 in such a manner that the small diameter end portion 143*a* is mounted on the inner end portion of the rod 16 and placed on the deep wall of the recess, while the large diameter end portion 143*b* surrounds the protrusion 142 and abuts against the end face of the plunger 7.

Both the recess 141 and the protrusion 142 are in the form of a circular truncated cone; however, the former 141 is larger than the latter 142. Therefore, when the end face of the plunger 7, being attracted, is abutted against the end face of the stationary iron core 12, a space is formed between the recess 141 and the protrusion 142 to accommodate the conically coiled spring 143 when compressed.

Thus, in the electromagnetic switch 140 of FIG. 10, similarly as in the electromagnetic switch 130 shown in FIG. 8, without adversely affecting the operation, the plunger returning spring can be located closer to the central axis of the stationary core, thus maintaining the magnetic cross section. In addition, the tapered surfaces of the recess 141 of the stationary iron core and the protrusion 142 of the plunger are substantially in parallel with each other as shown by the cross section, so that the magnetic flux flow distance there is reduced as much. Therefore, the electromagnetic switch shows a greater initial force of attraction.

Figure 12:
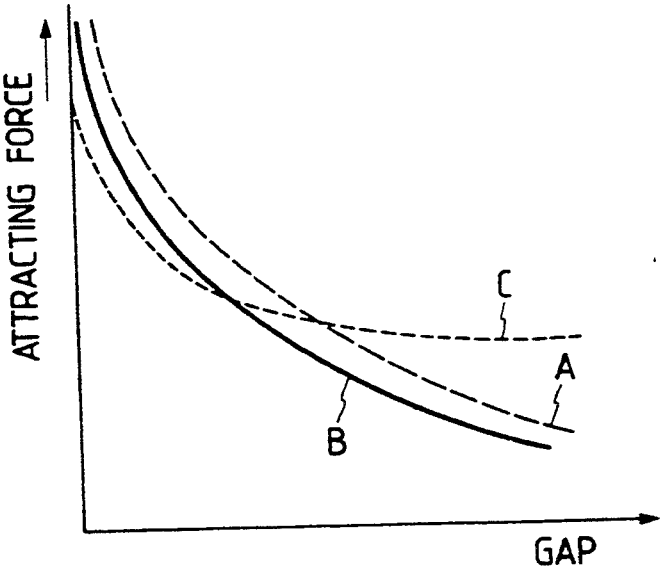
FIG. 12 is a graphical representation indicating the forces of attraction of the above-described two electromagnetic switches according to the invention, and of a conventional electromagnetic switch.

The force of attraction of the electromagnetic switch shown in FIG. 10 is as indicated by the characteristic curve C in FIG. 12. As is apparent from FIG. 12, of the above-described electromagnetic switches, the initial force of attraction of the electromagnetic switch 140 shown in FIG. 10 is greater than the other electromagnetic switches when the distance or gap q between the stationary iron core 12 and the plunger 7 is largest.

As was described above, in the starter of the invention, when the pinion is moved towards the engine ring gear by the plunger attracting force, the force applied to the pinion, after the pinion is abutted against the engine ring gear, is converted into the force of deflecting the conically coiled compression spring, which force pushes the pinion against the engine ring gear. Therefore, the force of pushing the pinion against the engine ring gear changes like an inverse exponential curve, as in the plunger attracting force characteristic curve. Thus, the starter of the invention is free from the difficulty that, when the voltage for operating the electromagnetic switch is somewhat decreased, the plunger attracting force becomes in balance with the elastic force of the compression spring, so that the motor does not start. Thus, the starter of the invention can be formed without using a large electromagnetic switch.

As was described above, in the electromagnetic switch, the conically coiled spring for returning the movable iron core is arranged between the stationary iron core and the movable iron core and substantially along the central axis, thus maintaining the magnetic cross section without adversely affecting the operation of the electromagnetic switch. Therefore, the electromagnetic switch of the invention can provide a greater force of attraction than the conventional electromagnetic switch; in other words, for the same force of attraction, the electromagnetic switch of the invention can be made smaller in size than the conventional one.

While there has been described in connection with the preferred embodiments of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. An electromagnetic attracting unit comprising:

a casing:

a stationary iron core fixed inside said casing;

a rod slidably set in said stationary iron core and mounted for movement with respect to said stationary iron core, said rod protruding from said stationary iron core and said stationary iron core supporting said rod;

an electromagnet;

a movable iron core slidably supported in said casing with respect to said stationary iron core and mounted for movement with respect to said rod, said movable iron core being confronted coaxially with said stationary iron core and moved toward said stationary iron core by electromagnetic force generated by said electromagnet; and a conically coiled spring interposed between said stationary iron core and said movable iron core, said conically coiled spring being substantially coaxial with said stationary iron core and said movable iron core.

2. An electromagnetic attracting unit as claimed in claim 1, wherein said conically coiled spring is gradually decreased in diameter from one end to the other end thereof, and each of said conically coiled spring goes inside the next coil larger in diameter when compressed.

3. An electromagnetic attracting unit as claimed in claim 1, wherein said stationary iron core is provided with a cylindrical recess at an inner end surface thereof, said cylindrical recess having an axial depth equal to the length of said conically coiled spring when said movable iron core abuts said stationary iron core, one end of said conically coiled spring being positioned along the peripheral bottom of said cylindrical recess.

4. An electromagnetic attracting unit as claimed in claim 3, wherein said movable iron core is provided with a circular protrusion, the other end of said conically coiled spring is fitted on said circular protrusion.

5. An electromagnetic attracting unit comprising:

an electromagnet;

a stationary iron core;

a movable iron core which is confronted coaxially with said stationary iron core and moved toward said stationary iron core by electromagnetic force generated by said electromagnets; and a conically coiled spring interposed between said stationary iron core and said movable iron core, said conically coiled spring being substantially coaxial with said stationary iron core and said movable iron core;

wherein said stationary iron core is provided with a cylindrical recess at an inner end surface thereof, said recess having an axial depth equal to the length of said conically coiled spring when said movable iron core abuts said stationary iron core, one end of said conically coiled spring being positioned along the peripheral bottom of said cylindrical recess;

wherein said movable iron core is provided with a circular protrusion, the other end of said conically coiled spring being fitted on said circular protrusion; and wherein said cylindrical recess and said protrusion are in the form of a circular-truncated-cone.

* * * * *